US006357505B1

(12) United States Patent
Jürgens

(10) Patent No.: US 6,357,505 B1
(45) Date of Patent: Mar. 19, 2002

(54) APPARATUS FOR TRANSFERRING FLEXIBLE STRIP-SHAPED OBJECTS FROM THE UNDERSIDE OF A MAGAZINE TO A CONVEYOR

(75) Inventor: Eric Jürgens, Hamburg (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 0 days.

(21) Appl. No.: 09/245,925

(22) Filed: Feb. 8, 1999

(30) Foreign Application Priority Data

Feb. 6, 1998 (DE) ..... 198 05 697

(51) Int. Cl.[7] ..... B65C 1/04; B65C 1/06; B65C 9/08

(52) U.S. Cl. ..... 156/564; 156/570; 156/571; 156/572; 156/573; 156/DIG. 29

(58) Field of Search ..... 156/571, 573, 156/570, 569, 566, 567, 568, DIG. 3, DIG. 4, 572, 556, 564

(56) References Cited

U.S. PATENT DOCUMENTS

| | | | | |
|---|---|---|---|---|
| 3,537,934 A | * | 11/1970 | Munch | 156/571 |
| 4,060,229 A | * | 11/1977 | Carter | 271/33 |
| 4,243,467 A | * | 1/1981 | Zodrow | 156/568 |
| 4,876,839 A | * | 10/1989 | Honda et al. | 53/137 |
| 5,111,633 A | * | 5/1992 | Draghetti | 53/136.1 |
| 5,203,953 A | | 4/1993 | Focke et al. | 156/566 |

FOREIGN PATENT DOCUMENTS

| | | |
|---|---|---|
| DE | 1 194 875 | 6/1965 |
| DE | 1 206 785 | 12/1965 |
| DE | 1 486 158 | 12/1969 |
| DE | 21 17 311 | 10/1972 |
| DE | 25 11 995 | 9/1976 |
| DE | 41 33 404 | 4/1993 |
| DE | 41 33 404 A1 | 4/1993 |

OTHER PUBLICATIONS

Translation of German Patent No. 1,486,156.*

* cited by examiner

*Primary Examiner*—Richard Crispino
*Assistant Examiner*—Sue A. Purvis
(74) *Attorney, Agent, or Firm*—Venable; George H. Spencer; Robert Kinberg

(57) ABSTRACT

Apparatus for delivering successive lowermost strip- or sheet-shaped commodities, such as labels, from a stack of commodities to a conveyor employs a rotary and reciprocable transfer member which pneumatically removes successive lowermost commodities from the stack, pneumatically attracts the commodities during transfer from the stack, and ceases to attract the commodities upon arrival at a station where the commodities are taken over by the pneumatically operated conveyor, such as an indexible or continuously driven rotary drum-shaped conveyor. The transfer member is reciprocated between the magazine and the conveyor by a reciprocable carriage which further serves to reciprocate a fluid flow regulating member acting as a valve to establish and interrupt the flow of air from one or more inlets of the transfer member to a suction generating device. The movements of various mobile constituents of the apparatus are synchronized, and such constituents can receive motion from a common prime mover.

16 Claims, 2 Drawing Sheets

APPARATUS FOR TRANSFERRING FLEXIBLE STRIP-SHAPED OBJECTS FROM THE UNDERSIDE OF A MAGAZINE TO A CONVEYOR

CROSS-REFERENCE TO RELATED CASES

This application claims the priority of German patent application Serial No. 198 05 697.4 filed Feb. 6, 1998. The disclosure of the German patent application, as well as that of each US and foreign patent and patent application mentioned in the specification of the present application, is incorporated herein by reference.

BACKGROUND OF THE INVENTION

The present invention relates to improvements in apparatus for transferring flexible strip-shaped objects or commodities (such as labels, blanks, tabs or the like) from the underside of a magazine (e.g., an upright or a downwardly sloping chute or duct) to a conveyor, e.g., to a continuously or intermittently driven rotary drum-shaped conveyor in a machine for packing plain or filter cigarettes or other smokers' products in a production line.

For example, the apparatus of the present invention can be utilized with advantage for the delivery of revenue labels to successive soft or hinged-lid cigarette packets in machines which confine arrays of (e.g., twenty) plain or filter cigarettes in blanks made of metallic foil, cardboard, paper, transparent platic foil or in a combination of two or more such blanks.

Apparatus of the type to which the present invention pertains can be utilized with equal or similar advantage for the application of adhesive-coated or un-coated labels, stamps or other flexible objects to all kinds of containers or receptacles as well as for the application of postage stamps to letters, post cards or the like.

Reference may be had, for example, to published German patent application Serial No. 41 33 404 A1 which describes and shows an apparatus for the application of flexible labels or the like to various types of products including cigarette packets or other block-shaped or otherwise configurated goods.

A revenue stamp or label is normally applied to a cigarette packet in such a way that the packet becomes tamper-proof, i.e., that the revenue stamp or label must be damaged or destroyed by the person who is in the process of gaining access to the contents of the packet. This is intended to ensure that the label or stamp cannot be reused by the manufacturer of cigarette packets or of packets or containers for other types of products for which taxes or duties are payable to Federal authorities, to State authorities and/or to local authorities.

For example, a revenue label can be applied to the overlapping flaps and/or tucks at one end of a flexible transparent outermost envelope which is normally provided with a tear strip. Alternatively, the revenue label can be applied in part to the exterior of a closed hinged lid and in part to the adjacent part of the main portion of a hard cigarette packet which contains a housing made of cardboard or the like so that the label must be destroyed when the lid is pivoted to open position in order to enable the purchaser of the hinged-lid packet of plain or filter cigarettes, cigarillos or the like to gain access to the contents, e.g. , an array of twenty cigarettes in the customary so-called quincunx formation. The same holds true when the revenue labels are applied to packets which contain arrays of five, ten or twentyone cigarettes.

A modern cigarette packing machine can turn out cigarette packets at a very high rate. By way of example, the so-called COMPAS 500 cigarette packer (distributed by Topack Verpackungstechnik GmbH, Grabauer Strasse 49, D-21493 Schwarzenbek, Federal Republic Germany) can turn out up to and well in excess of 500 cigarette packets per minute. In such mass-producing machines, revenue labels must be supplied at a very high frequency and with an extremely high degree of accuracy and reproducibility in order to reduce to a minimum the number of rejects which are discovered during the final quality review of the finished packets.

Additional problems arise when the labels are relatively small or extremely small because this evidently aggravates the problem of reliably transporting such objects between one or more magazines or makers of labels and one or more processing stations, e.g., past an adhesive applying paster and into a cigarette wrapping or packing machine (such as the aforementioned COMPAS 500 machine) or an overwrapping machine (such as that known as Pewo-Fold overwrapper, also distributed by Topack).

OBJECTS OF THE INVENTION

An object of the invention is to provide an apparatus which can manipulate labels, stamps and like flexible objects with a high degree of accuracy regardless of whether such objects must be supplied to a consuming machine at a low, medium high or extremely high frequency.

Another object of the invention is to construct and assemble the apparatus in such a way that the flexible objects are treated gently regardless of the frequency at which such objects are furnished to a cigarette packing or another labelling machine.

A further object of the invention is to provide the above outlined apparatus with novel and improved means for transferring successive flexible objects from one or more sources to a conveyor, e.g., to a conveyor in a cigarette packing machine.

An additional object of the invention is to provide the apparatus with novel and improved means for reliably holding successive flexible objects in optimum positions during lateral, orbital, linear or any other required movements in the path between an object making or storing station and a device which receives and further transports and/or otherwise manipulates successive objects of a short or long series of such commodities.

Still another object of the invention is to provide a novel and improved object transferring device which can be utilized in the above outlined apparatus.

A further object of the invention is to provide a novel and improved synchronizing system for use in the above outlined apparatus to ensure predictable and reliable cooperation between various moving parts of the above outlined apparatus.

An additional object of the invention is to provide a cigarette packing machine which embodies at least one apparatus of the above outlined character.

Still another object of the invention is to provide a novel and improved method of manipulating adhesive-coated or uncoated labels or analogous flexible objects between one or more sources and one or more consuming or processing machines.

A further object of the invention is to provide a method of removing successive flexible objects from the bottom region of an upright or downwardly sloping magazine to one or more processing stations in such a way that each of a short or long series of objects is adequately controlled during each and every stage of the manipulation.

SUMMARY OF THE INVENTION

The invention is embodied in an apparatus for delivering successive flexible sheet-like commodities (such as labels, tabs, stamps, blanks or the like) from a source (such as an upright or downwardly inclined magazine) to a conveyor which is spaced apart from the source. The improved apparatus comprises a suction generating device (such as a pump, a blower or the like), a transfer member which is rotatable about a predetermined axis and has at least one air-admitting inlet, means for moving the transfer member between a first location at the source and a second location at the conveyor, and means for rotating the transfer member about the aforementioned axis relative to the moving member between at least one first position, in which the at least one inlet communicates with the suction generating device to attract a commodity at the first location and during movement from the first location to the second location, and at least one second position at the second location in which the suction generating device is at least partially sealed from the at least one inlet to thus enable the conveyor to accept commodities from the transfer member.

The source can comprise a magazine for a stack of superimposed commodities including a lowermost commodity at the first location.

The conveyor is preferably provided with suction ports which serve to attract commodities at the second location.

The improved apparatus can further comprise air flow regulating means which is provided on the moving means, which is connected to the suction generating device, and which defines at least one path for the flow of air from the at least one inlet at the first location and during movement of the transfer member from the first location toward the second location.

The at least one inlet can be provided at the peripheral surface of the transfer member.

The conveyor is or can constitute a rotary conveyor having a peripheral surface with circumferentially spaced apart portions for reception of commodities at and for removal of commodities from the second location. Such conveyor can be provided with a plurality of platforms, and the aforementioned portions of the peripheral surface of the rotary conveyor are then provided on the platforms.

The moving means can comprise a carriage which is reciprocable along a substantially straight path to thus move the transfer member between the first and second locations.

The means for rotating the transfer member can comprise means for turning the transfer member about the aforementioned axis in a first direction during movement of the transfer member from the first location and in a second direction at least substantially counter to the first direction during movement of the transfer member from the second location. The means for rotating the transfer member can receive motion from the moving means.

The apparatus preferably further comprise means for synchronizing the operation of the moving means with the operation of the rotating means.

Still further, the improved apparatus can comprise a valve which is provided on the moving means and is arranged to regulate the flow of air from the at least one inlet to the suction generating device.

The axis of the transfer member is or can be at least substantially horizontal, and one of the first and second locations is or can be disposed at a level above the other of the first and second locations.

In accordance with a presently preferred embodiment, the aforementioned source includes at least one magazine for a supply of commodities in the form of labels.

The at least one inlet can include a suction port which is provided in an arcuate surface of the transfer member.

The peripheral surface of the transfer member can be provided with a recess which confronts the source when the transfer member is disposed at the first location, and the at least one inlet is arranged to draw air from the recess when the recess is adjacent the source. The peripheral surface can include a concave portion which bounds the aforementioned recess, and the transfer member can be provided with at least one additional inlet which communicates with the suction generating device during movement of the transfer member from the first location to the second location. In such apparatus, the aforementioned valve is arranged to seal one of (a) the at least one inlet and (b) the at least one additional inlet from the suction generating device when the other of the (a) at least one inlet and (b) the at least one additional inlet communicates with the suction generating device. The at least one additional inlet can be located ahead of the at least one inlet, as seen in the direction of rotation of the transfer member during movement from the first location toward the second location.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 3:
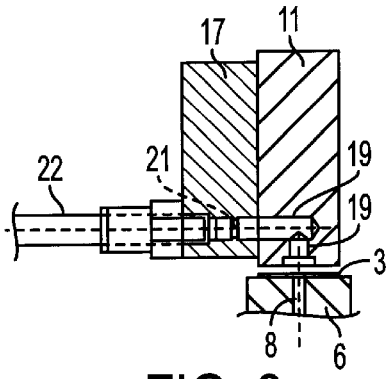
FIG. 3 is a fragmentary sectional view substantially as seen in the direction of arrows from the line C–D in FIG. 1.

The apparatus which is shown in the drawings comprises a housing or frame 5 which supports or is adjacent the lower end portion of an upright or downwardly sloping magazine 1 constituting a source of superimposed sheet- or strip-shaped commodities 3 in the form of labels, tabs, stamps or the like (hereinafter again called labels for short) The magazine 1 contains a stack 2 of labels 3 and its lower or discharge end is adjacent the path of movement of a reciprocatory transfer member 11 which is rotatable about a horizontal axis X and is movable between a first location (shown in FIG. 4 by solid lines and also shown in FIG. 1 beneath and adjacent the magazine 1), and a second location shown in FIG. 4 by broken lines, shown in FIG. 3, and also shown in FIG. 1 to the right of and at a level below the level of the lower end of the magazine.

Figure 1:
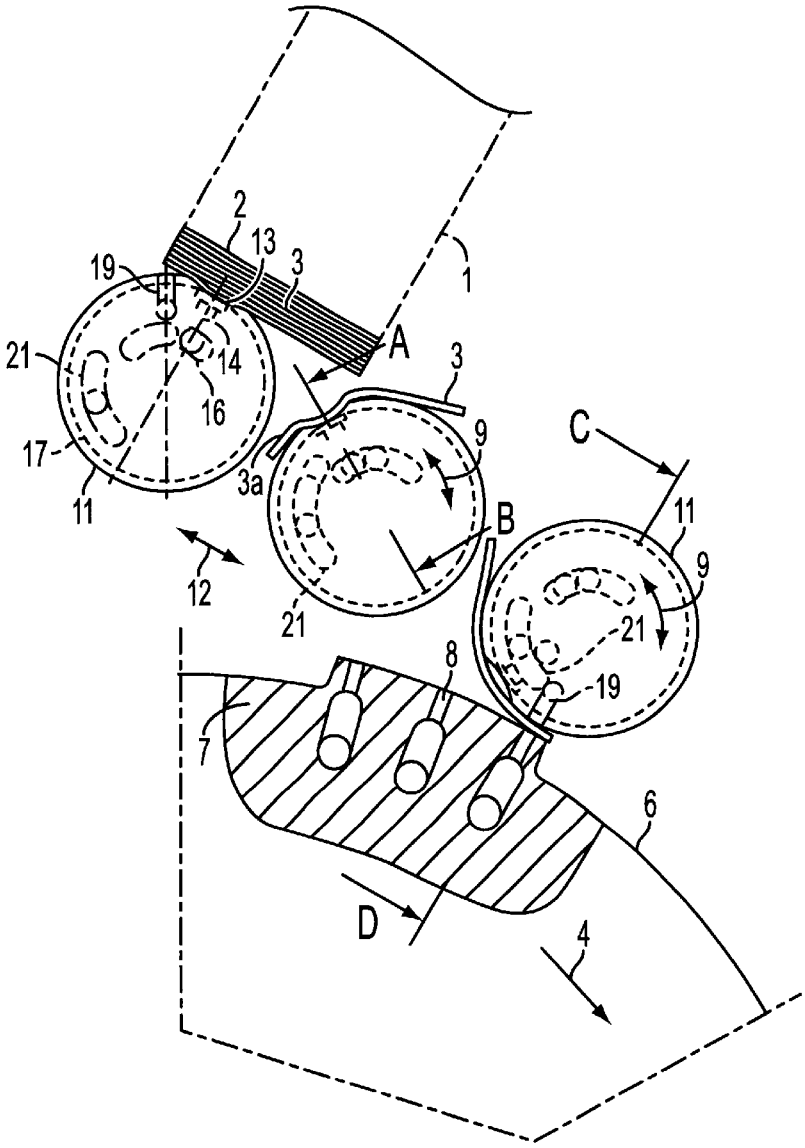
FIG. 1 is a fragmentary partly front elevational and partly sectional view of an apparatus which embodies one form of the invention and can be utilized for the application of revenue labels in a cigarette packing machine.
Figure 4:
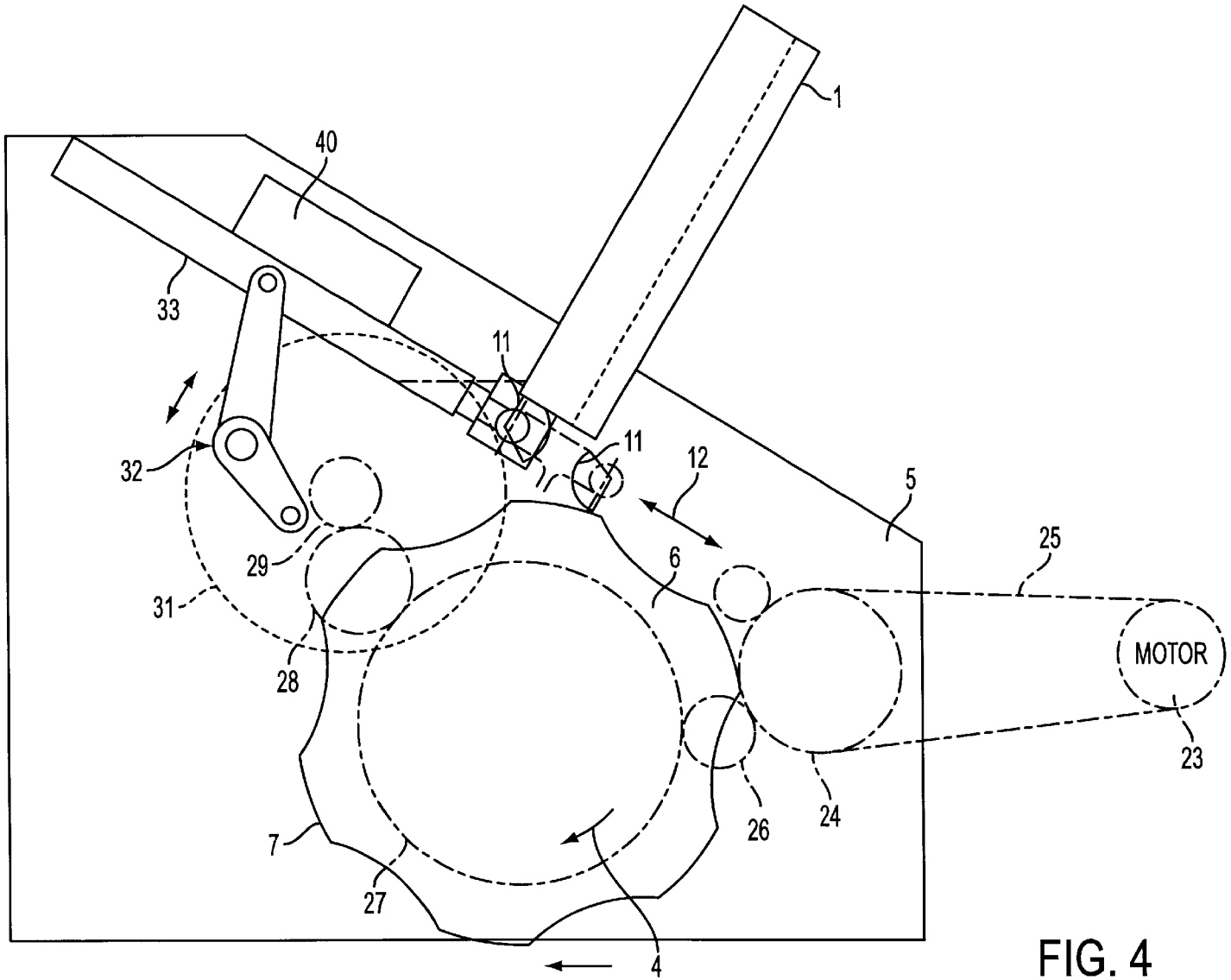
FIG. 4 is a partly diagrammatic front elevational view of the apparatus which embodies the structure shown in FIGS. 1 to 3.

When at the first location, the transfer member 11 accepts (actually extracts) the lowermost label 3 of the stack 2 from the magazine 1 and is thereupon caused to transport the label to the second location where the latter is taken over by a suction-operated rotary drum- or wheel-shaped conveyor 6 arranged to rotate (intermittently or continuously) in a clockwise direction (see the arrow 4 in FIGS. 1 and 4). The purpose or function of the conveyor 6 is or can be that of the conveyor 12 shown in FIG. 1 of published German patent application Serial No. 41 33 404 the disclosure of which is incorporated herein by reference. Thus, the conveyor 6 can advance successive labels 3 of a short or long series of labels past an adhesive applying station and thereupon onto successive ones of a succession of cigarette packets or the like.

The conveyor 6 is provided with several equidistant platforms 7, and those portions of the peripheral surface of the conveyor 6 which are provided on the platforms 7 have suitably distributed suction ports 8 which are connected to a suction generating device (such as a fan or a pump) whenever the respective platform reaches the second location of the transfer member 11. At such time, the inlet or inlets 14 in the peripheral surface of the transfer member are at least partially sealed from a pipe or hose 18 forming part of a suction generating device and having its intake end connected to a regulating member 17 which is adjacent to but does not rotate with the member 11. Consequetly, the label 3 which has been delivered by the member 11 can be taken over by the adjacent platform 7 which conveys the label to the next processing station.

Figure 2:
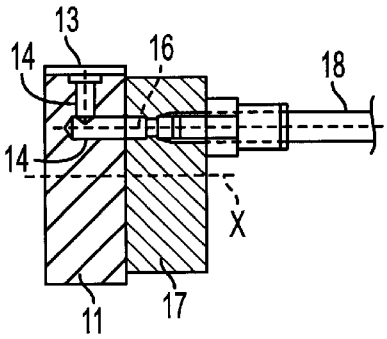
FIG. 2 is a fragmentary sectional view as seen in the direction of arrows from the line A–B in FIG. 1.

The means for reciprocating the transfer member 11 and the aforementioned air flow regulating member 17 (hereinafter called valve for short) between the first and second locations comprises a carriage 33 which is reciprocable along an at least substantially straight path in directions indicated by the arrow 12 (FIGS. 1 and 4). The carriage 33 further supports or cooperates with means 40 (e.g., a reversible electric motor, a cam and follower unit, a linkage or the like) for rotating the member 11 in a first direction (counterclockwise) during travel from the first location to the second location (i.e., from the magazine 1 to a platform 7 of the conveyor 6) and in a second direction (clockwise) during travel from the second location back to the first location. The directions of rotation of the transfer member 11 relative to the valve 17 and carriage 33 are indicated in FIG. 1 by double-headed arrows 9. FIG. 1 further shows an intermediate position of the transfer member 11, and the corresponding angular position of the member 11 reative to the valve 17 is shown in FIG. 2.

The air evacuating system of the improved apparatus comprises the aforementioned inlet or inlets 14 provided in the peripheral surface of the transfer member 11 to draw air from a relatively shallow recess 13 at least when the member 11 occupies the first location beneath the lower end of the magazine 1. At such time, the recess 13 is adjacent the underside of the lowermost label 3 of the stack 2 and at such time, the inlet 14 communicates with the pipe or hose 18 of the suction generating device to ensure that an intermediate portion of the lowermost label 3 is caused to enter the recess 13 but the adjacent marginal portion 3*a* of such label is not attracted to the periphery of the member 11. The valve 17 has one or more channels or bores 16 which establish communication between the inlet 14 (i.e., between the recess 13) and the intake end of the pipe 18.

FIG. 1 shows that, when the transfer member 11 is being moved from the first location toward the second location, the inlet or inlets 14 of such member continue to attract the label 3 to the periphery of the member 11, and the intermdiate portion of such label (next to the marginal portion 3*a*) continues to extend into the recess 13. The peripheral surface of the transfer member 11 is or can be provided with one or more additional inlets 19 (FIG. 3) which communicate with the pipe 22 of the suction generating device by way of a slot or groove 21 in the valve 17 to thus attract an additional portion of the label 3.

One presently preferred embodiment of the improved apparatus is shown in FIG. 4. The apparatus comprises a prime mover 23 (e.g., a variable-speed electric motor) which can transmit torque to a pulley or gear 24 by way of an endless belt or chain 25. The rotary member 24 has a shaft which is journalled in the frame 5 and serves to transmit torque to the shaft of the conveyor 6 by way of gears 26, 27. The gear 27 transmits torque to a gear 28 which drives a pinion 29 on the shaft of a disc cam 31. The latter transmits reciprocatory motion to the carriage 33 by way of a crank drive 32 or in any other suitable way. The valve 17 is non-rotatably mounted on the carriage 33, and the transfer member 11 is rotatable relative to the carriage 33 and valve 17 by the reversible motor 40. The latter can be caused to reverse the direction of rotation of the transfer member 11 (with or without a predetermined delay) upon arrival of the member 11 at the first and/or second location.

The operation is as follows:

When the transfer member 11 reaches the first location at the lower or discharge end of the magazine 1, the inlet 14 is in communication with the flexible pipe or hose 18 of the suction generating device so that an intermediate portion of the lowermost label 3 of the stack 2 in the magazine is attracted to that (flat or concave) portion of the peripheral surface of the member 11 which bounds the recess 13. The member 11 is rotated in a counterclockwise direction (as viewed in FIG. 1) so that the lowermost label 3 is peeled off the immediately adjacent next-to-the-lowermost label in the stack 2. In addition to being rotated in a counterclockwise direction (by the motor 40), the transfer member 11 is also advanced (by the carriage 33) from the first location beneath the magazine 1, through the intermediate position, and toward the second location adjacent the oncoming platform 7 of the conveyor 6. As already mentioned hereinbefore, the transfer member 11 is rotatable relative to the carriage 33 as well as relative to the valve 17.

The additional inlet or inlets 19 of the transfer member 11 cooperate with the arcuate groove or slot 21 of the valve 17 to ensure that the label 3 shares the movement of the member 11 toward the second location, i.e., the slot 21 ensures that the additional inlet or inlets 19 can communicate with the intake end of the flexible pipe or hose 22 forming part of the suction generating device The latter can comprise two discrete suction generating units one of which draws air from the pipe 18 and the other of which draws air from the pipe 22. The inlets 14 and 19 of the transfer member 11 are at least partially sealed from the pipes 18 and 22 when the member 11 reaches the second location so that the ports 8 of the platform 7 which is then adjacent the member 11 can attract the label and peel it off the peripheral surface of the member 11 while the latter continues to turn in a counterclockwise direction and while the conveyor 6 rotates in a clockwise direction (as viewed in FIGS. 1 and 4).

The ports 8 can be connected to the suction generating device which includes or draws air from the pipe 18 and/or 22, or to a further suction generating device. The motor 40 causes the transfer member 11 to turn in a clockwise direction not later than when the transfer of the label 3 onto the platform 7 is completed. The carriage 33 performs a return stroke to move the transfer member 11 from the level of the second location (at the conveyor 6) to the higher level of the first location (beneath the magazine 1) while the member 11 turns in a clockwise direction to assume the prescribed starting angular position (in which its recess 13 is located at or close to the one o'clock position shown in the left-hand portion of FIG. 1) beneath an intermediate portion of the lowermost label 3 of the stack 2 in the magazine 1.

The aforedescribed sequence of steps is thereupon repeated as often as necessary to transfer a requisite number of successive labels 3 from the magazine 1 onto successive cigarette packets, letters or the like (depending upon the nature of the goods which are to be labelled or stamped).

FIG. 1 shows that, during the initial stage of transfer of the lowermost label 3 of the stack 2 in the magazine 1 onto the peripheral surface of the transfer member 11, the marginal portion 3*a* of such label is spaced apart from the peripheral surface of the member 11. This is due to the provision of the inlet or inlets 14 in the recess 13 of the transfer member 11. When the member 11 reaches the intermediate position of FIG. 1 (in which the label 3 being carried by the member 11 is spaced apart from the magazine 1 as well as from the conveyor 6), the additional inlet or inlets 19 communicate with the slot 21 of the valve 17 and the inlet or inlets 14 continue to communicate with the pipe 18 so that the intermediate portion of such label continues to hug the flat or conical surface portion bounding the recess 13. The leading marginal portion 3*a* of the label 3 advancing with the transfer member 11 is hereupon attracted to the cylindrical peripheral surface of the member 11 because the inlet or inlets 19 of the member 11 then communicate with the suction pipe 22 by way of the slot 21 in the valve 17. The just described mode of manipulating the labels during transfer from the magazine 1 to the conveyor 6 ensures a highly predictable transfer of labels onto successive platforms 7. FIG. 1 shows that, during transfer toward and onto the oncoming platform 7, the nearest (front) marginal portion 3*a* of the label 3 which has been removed from the stack 2 is substantially tangential to the surface of the platform.

The manner in which selected suction ports (8) of a rotary conveyor (6) are selectively connectable to and sealable from a suction generating device during certain stages of each revolution of the conveyor is well known in the art of making, packing and otherwise processing plain or filter tipped cigarettes, cigarillos and the like An important advantage of the improved apparatus is that the transfer member 11 can reliably attract the leading marginal portion 3*a* of a label 3 which approaches the oncoming platform 7 of the conveyor 6 so that the edge of such leading marginal portion cannot impinge upon and cannot be damaged by the platform.

Another advantage of the improved apparatus is that alternating clockwise and counterclockwise angular movements of the transfer member 11 can be readily synchronized with the reciprocatory movements of the carriage 33 to thus ensure that the member 11 invariably assumes optimal angular positions at each of the first and second locations, i.e., successive lowermost labels 3 can be removed from the magazine 1 in a predictable manner and successive labels 3 can be transferred onto successive platforms 7 of the conveyor 6 in an equally predictable optimum manner. Such predictability is attributable, at least in part, to the just described synchronization of movements of the conveyor 6, transfer member 11 and carriage 33 as well as to the provision of the recess 13 in that portion of the peripheral surface of the member 11 which is provided with the inlet or inlets 14. The distribution of bore(s) 16 and slot(s) 21 in the valve 17 can be readily selected with a view to ensure the aforedescribed sequence of pneumatically effected attraction of selected portions of successive labels 3 to selected portions of the peripheral surface of the transfer member 11.

A highly predictable manipulation of labels (not only as concerns the integrity of the leading marginal portions 3*a* but also as concerns predictable orientation of successive labels on the adjacent platforms) is desirable and necessary in many fields, e.g., for the application of revenue labels or the like to packets of plain or filter cigarettes, cigarillos and other smokers' products in a manner as disclosed in the afore-mentioned published German patent application Serial No. 41 33 404.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for manipulating flexible sheet-like commodities and, therefore, such adaptations should and are intended to be comprehended within the meaning and range of equivalence of the appended claims.

What is claimed is:

1. Apparatus for delivering successive flexible commodities from a source to a conveyor which is spaced apart from the source, comprising;

a suction generating device;

a transfer member rotatable about a predetermined axis and having one air-admitting inlet;

means for moving said transfer member between a first location at said source and a second location at said conveyor;

means for rotating said transfer member about said axis relative to said moving means between at least one first position, in which said one inlet communicates with said suction generating device to attract a commodity at said first location and during movement from said first location to said second location, and at least one second position at said second location in which said suction generating device is at least partially sealed from said one inlet to thus enable said conveyor to accept commodities from said transfer member; and said moving means comprising a carriage which is reciprocable along a substantially straight path to thus move said transfer member between said first and second locations.

2. Apparatus for delivering successive flexible commodities from a source to a conveyor which is spaced apart from the source, comprising;

a suction generating device;

a transfer member rotatable about a predetermined axis and having one air-admitting inlet;

means for moving said transfer member between a first location at said source and a second location at said conveyor;

means for rotating said transfer member about said axis relative to said moving means between at least one first position, in which said one inlet communicates with said suction generating device to attract a commodity at said first location and during movement from said first location to said second location, and at least one second position at said second location in which said suction generating device is at least partially sealed from said one inlet to thus enable said conveyor to accept commodities from said transfer member; and said means for rotating comprising means for turning said transfer member about said axis in a first direction during movement of said transfer member from said first location and in a second direction at least substantially counter to said first direction during movement of said transfer member from said second location.

3. The apparatus of claim 2, wherein said means for rotating receives motion from said moving means.

4. Apparatus for delivering successive flexible commodities from a source to a conveyor which is spaced apart from the source, comprising;

a suction generating device;

a transfer member rotatable about a predetermined axis and having one air-admitting inlet;

means for moving said transfer member between a first location at said source and a second location at said conveyor;

means for rotating said transfer member about said axis relative to said moving means between at least one first position, in which said one inlet communicates with said suction generating device to attract a commodity at said first location and during movement from said first location to said second location, and at least one second position at said second location in which said suction generating device is at least partially sealed from said one inlet to thus enable said conveyor to accept commodities from said transfer member.

said transfer member having a peripheral surface provided with a recess which confronts said source when said transfer member is disposed at said first location, said one inlet being arranged to draw air from said recess when said recess is adjacent said source;

said transfer member having at least one additional inlet which communicates with said suction generating device during movement of said transfer member from said first location to said second location;

said at least one additional inlet located ahead of said at least one inlet as seen in the direction of rotation of said transfer member during movement from said first location toward said second location; and a valve arranged to seal one of (a) said one inlet and (b) said at least one additional inlet from said suction generating device when the other of said (a) one inlet and (b) said at least one additional inlet communicates with said suction generating device.

5. The apparatus of claim 4, wherein said source includes a magazine for a stack of superimposed commodities including a lowermost commodity at said first location.

6. The apparatus of claim 4, wherein said conveyor has suction ports arranged to attract commodities at said second location.

7. The apparatus of claim 4, further comprising air flow regulating means provided on said moving means, connected to said suction generating device and defining at least one path for the flow of air from said at least one inlet at said first location and during movement of said transfer member from said first location toward said second location.

8. The apparatus of claim 4, wherein said transfer member has a peripheral surface and said at least one inlet is provided at said peripheral surface.

9. The apparatus of claim 4, wherein said conveyor is a rotary conveyor having a peripheral surface with circumferentially spaced apart portions for reception of commodities at and for removal of commodities from said second location.

10. The apparatus of claim 9, wherein said conveyor has a plurality of platforms and said portions of said peripheral surface are provided on said platforms.

11. The apparatus of claim 4, further comprising means for synchronizing the operation of said moving means with the operation of said rotating means.

12. The apparatus of claim 4, further comprising a valve provided on said moving means and arranged to regulate the flow of air from said at least one inlet to said suction generating device.

13. The apparatus of claim 4, wherein said axis is at least substantially horizontal and one of said locations is disposed at a level above the other of said locations.

14. The apparatus of claim 4, wherein said source includes at least one magazine for a supply of commodities in the form of labels.

15. The apparatus of claim 4, wherein said at least one inlet includes at least one suction port provided in an arcuate surface of said transfer member.

16. The apparatus of claim 4, wherein said peripheral surface has a concave portion which bounds said recess.

* * * * *